United States Patent [19]

Ottolini

[11] 4,392,319

[45] Jul. 12, 1983

[54] SAFETY DEVICE FOR THE TRIGGER MECHANISM OF A SHOT-GUN OF THE GAS-PUMP TYPE

[75] Inventor: Leonardo Ottolini, Brescia, Italy

[73] Assignee: Luigi Franchi S.p.A., Fornaci, Italy

[21] Appl. No.: 313,084

[22] Filed: Oct. 20, 1981

[30] Foreign Application Priority Data

Nov. 10, 1980 [IT] Italy ..... 25858 A/80

[51] Int. Cl.[3] ..... F41C 11/06

[52] U.S. Cl. ..... 42/69 B; 42/17

[58] Field of Search ..... 42/69 B, 16, 17

[56] References Cited

U.S. PATENT DOCUMENTS 1,638,783 8/1927 Philippart ..... 42/69 B

*Primary Examiner*—Charles T. Jordan
*Assistant Examiner*—Ted L. Parr
*Attorney, Agent, or Firm*—Sughrue, Mion, Zinn, Macpeak and Seas

[57] ABSTRACT

A safety device for the trigger mechanism of a gas-operated-automatic/pump-action-manual shot-gun comprises an over-center thrust spring assembly pivotally connected at one end to a fixed point on the gun and at the other end to a stop member defining lever. The thrust spring assembly is pivotable between a first position, in which it biases the said lever into an operative position, bearing against the breechblock carrier, and a second position in which it stabilizes the said lever in an inoperative position, out of the path of movement of the breechblock carrier, preventing rebound of the stop member defining lever into the said path.

3 Claims, 7 Drawing Figures

SAFETY DEVICE FOR THE TRIGGER MECHANISM OF A SHOT-GUN OF THE GAS-PUMP TYPE

BACKGROUND OF THE INVENTION

This invention relates to a safety device for the trigger mechanism of a shot-gun of the gas-pump type. In this specification and in the claims, by the term: shot-gun of the gas-pump type is meant a shot-gun in which the re-arming mechanism may be actuated either automatically, by the so-called gas-take-off method, or manually by the so-called pump-action technique. The re-arming mechanism of a gun of the type under consideration generally includes a breechblock mounted on a carrier guided for movement towards and away from a firing chamber, a spring which maintains the breechblock in a position in which it closes the firing chamber and which resists the movement of the carrier-breechblock group away therefrom, and a piston for driving the said carrier-breechblock group against the action of the firing-chamber-closure spring. When the re-arming mechanism of the gun is actuated by the so-called gas-take-off method, the piston is subjected to the action of a portion of the discharge gas which is drawn from the gun barrel into a cylinder in which the piston is axially movable. When the re-arming mechanism of the gun is actuated manually, the piston is made rigid with a fore-end-stock-slide, slidably mounted on the gun itself. A shot-gun of the gas-pump type is further provided with a device for converting it from automatic actuation to manual actuation of the re-arming mechanism and vice versa. Such a shot-gun of the gas-pump type is described in Patent Applications Nos. 22697 B/79 and 24595 A/80 filed on the 27th Sept. 1979 and the 11th Sept. 1980 respectively in the name of the same Applicant.

When a gun is in its ready-to-fire condition, the breechblock is held in its position in which it closes the firing chamber by a positive, removable catch, called a hook in this branch of the art, while the carrier is retained in a corresponding position by a stop member generally supported by the trigger mechanism housing of the gun, More particularly, the said stop member is constituted by a lever which is fixed at one end to the trigger mechanism housing and the other end of which bears against the rear wall of the carrier. Such a stop member must be of the escape type, that is to say, it must be displaceable into a non-operative position to allow the carrier to be displaced freely in the direction of opening of the firing chamber when it is required to re-arm the gun after firing. To this end, the cited stop member is connected to the hammer of the gun and follows its anguler displacement. At the moment of firing, as the hammer is angularly displaced to strike the firing pin, the cited stop member is angularly displaced about its respective pivot point so that its free end, which previously bore against the carrier, is displaced into a non-operative position, spaced from the said carrier or at least out of the path of movement thereof. From careful observation of the movement of the hammer towards the firing pin it could be seen that, in the act of striking the firing pin, the hammer rebounded before resting finally on the firing pin itself. This rebound, although rapid and limited in size, always causes an equivalent angular displacement of the cited stop member. In essence, at each firing, the cited stop member, before finally taking up its position in which it is spaced from the path of the carrier, undergoes a very rapid "return" angular displacement, which displacement, in the following description, will be called: rebound-effect displacement.

When the re-arming mechanism of a gas-pump shot-gun is actuated manually (pump action) the said rebound-effect displacement of the cited stop member is of no consequence since, because of the rapidity with which it occurs, the said stop member is safely in the non-operative position spaced from the path of the carrier at the moment at which the carrier is displaced (manually) in the direction of opening of the firing chamber.

However, when the re-arming mechanism is actuated automatically by the discharge gases drawn from the gun barrel, the displacement of the breechblock and its carrier in opening the firing chamber is so rapid and so violent that the carrier certainly strikes the free end of the lever-stop member while it is still effecting the said rebound-effect displacement. As a result, the lever-stop member and the trigger mechanism associated therewith may break.

OBJECT OF THE INVENTION

The problem which is at the root of this invention is, thus, to devise a safety device for the trigger mechanism of a shot-gun of the gas-pump type, which is such as to ensure the elimination of the rebound-effect displacement of the lever-stop member, that is to say, which ensures the retention of the lever-stop member in its inoperative position when the carrier is displaced in the direction of opening of the firing chamber; such a safety device must, moreover, allow the lever-stop member to take up its operative position again, with its free end bearing against the carrier, when the latter is in its position corresponding to closure of the firing chamber.

SUMMARY OF THE INVENTION

This problem is solved according to the invention by a safety device for the trigger mechanism of a gas-pump-type shot gun having a breechblock carrier supporting a breechblock for translational movement between a first position in which the firing chamber of the shot gun is closed and a second position in which the firing chamber is open, a stop member defining lever pivoted on the trigger-mechanism housing about an axis perpendicular to the direction of movement of the breechblock carrier for pivotal movement between an operative position, in which a free end thereof bears against the carrier when the breechblock is in the first position, and an inoperative position in which the said free end lies out of the path of movement of the carrier, characterised in that the safety device comprises a spring assembly pivotally connected at one end to the said lever and at the other end to a fixed point on the shot-gun, the straight line of action of the spring assembly extending to one side of a straight line joining the said fixed point to a point on the pivot axis of the said lever when the stop member defining lever is in its inoperative position such that the spring assembly biases the stop member defining lever towards the inoperative position, the spring assembly being in its condition of maximum loading when its straight line of action coincides with the said straight joining line.

BRIEF DESCRIPTION OF THE DRAWINGS

Further characteristics and advantages will become clearer from the following detailed description of one embodiment of a safety device according to the invention, made with reference to the appended drawings given purely by way of example, in which.

DESCRIPTION OF THE PREFERRED EMBODIMENT

Figure 1:
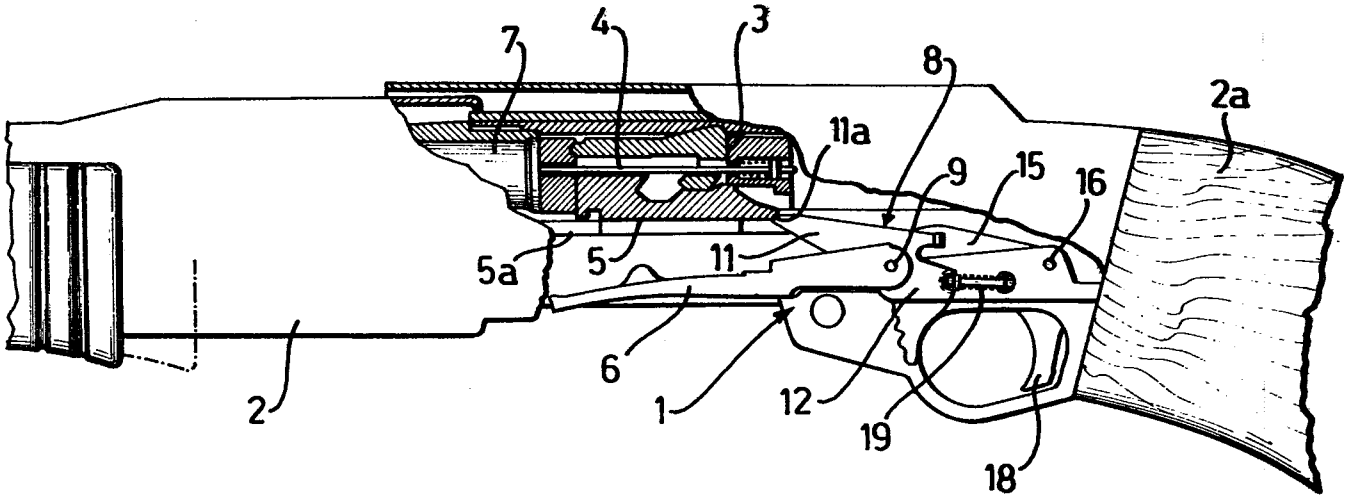
FIG. 1 shows schematically, in partial section, a portion of a shot-gun including the trigger mechanism of the gun and incorporating a safety device according to the invention.

With reference to the said Figures, by 1 is generally indicated a housing for the trigger mechanism of a gas-pump-type shot-gun 2, that is to say, a shot-gun in which the same re-arming mechanism may be actuated equally well, either automatically by the so-called gas-take-off method or manually by the conventional, so-called pump-action, the gun 2 having members (not shown) for converting it from one type of actuation of the re-arming mechanism to the other type and vice versa. Of the re-arming mechanism, in the appended drawings there are shown the breechblock 3 with its firing pin 4, the carrier 5 for supporting and actuating the breechblock 3 and the cartridge conveyor 6. In particular, the carrier 5 is actuated conventionally by a pair of parallel rods 5*a* which extend above and to the side of the trigger mechanism assembly of the gun. The carrier 5, actuated manually or automatically as described above, is reciprocated along a predetermined path away from and towards a firing chamber 7, carrying with it the breechblock 3 to positions in which it opens and closes the firing chamber respectively.

Figure 2:
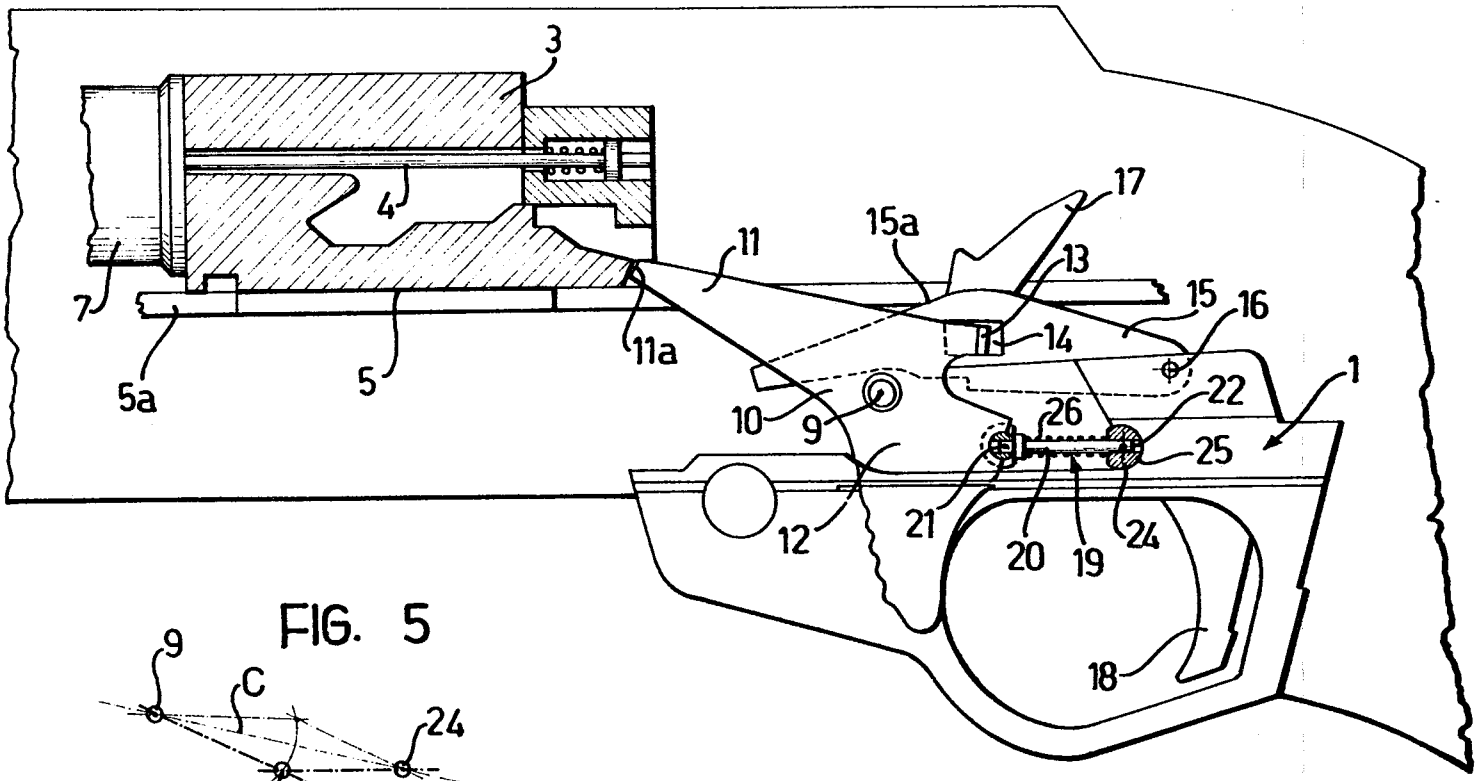
FIGS. 2, 3 and 4 show schematically, on an enlarged scale, the trigger mechanism of FIG. 1, incorporating the safety device of this invention in different positions of operation.
Figure 5:
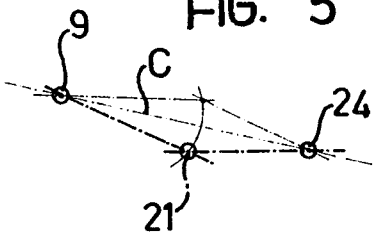
FIGS. 5, 6 and 7 are schematic representations of the different positions taken up by the safety device of the invention in the respective positions illustrated in FIGS. 2, 3 and 4.
Figure 3:
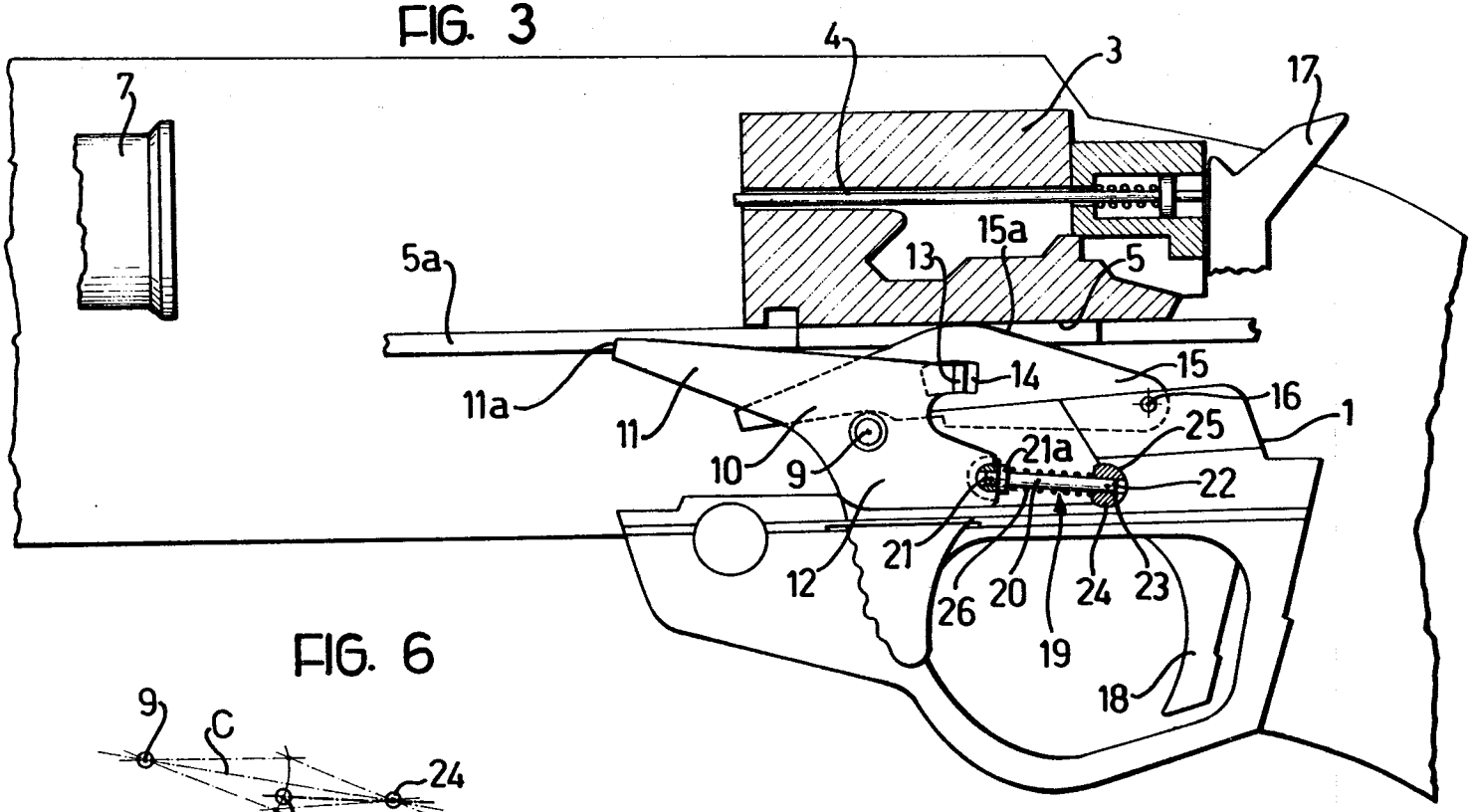
Figure 6:
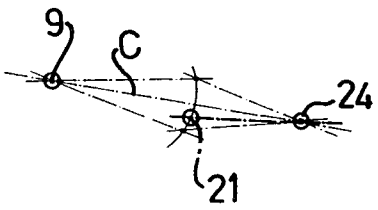

In FIGS. 1 and 2, the carrier 5 and the breechblock 3 are shown in the closed position of the said firing chamber 7; while the breechblock 3 is maintained in this position by a spring (not shown since it is conventional) and by the engagement of a hook 3*a* in a respective retaining seat, the carrier 5 is retained by a stop device generally indicated 8, the presence of which and the action of which are required particularly during operation of the gun with manual re-arming by pump action.

The said stop device comprises essentially a lever 10 in the form of a plate pivoted substantially centrally on a pin 9 carried by the trigger mechanism housing 1 and extending perpendicular to the direction of displacement of the carrier 5. The plate-like lever 10 includes an elongate portion 11 extending from the pin 9 towards the firing chamber 7, the portion 11 having a free end 11*a* which bears against the carrier 5 when the latter is retained in the position corresponding to closure of the firing chamber. The plate-like lever 10 defines a further portion 12 above which is a lug 13 exgaged transversely in a slot 14 formed in an arm 15 in the form of a plate. This arm 15 is rotatably mounted at one end on a pin 16 carried by the trigger mechanism housing 1 and extending parallel to the pin 9 of the plate-like lever 10. The arm 15, which extends parallel to the plate-like lever 10, has a curved upper edge 15*a* which is upwardly convex and constituted by two lateral sections rising towards a central highest portion. The upper curved edge 15*a* of the arm 15 lies in the path of movement of the carrier 5 as will be better understood from the description below.

The plate-like lever 10 is angularly displaceable about the axis of the pin 9 from an operative position, in which the free end 11*a* thereof bears against the carrier 5 (stop action) to an inoperative position in which the said free end is lowered so as to be completely below the carrier, and so as not to lie in the path of movement thereof during its displacements away from and towards the firing chamber 7.

Figure 4:
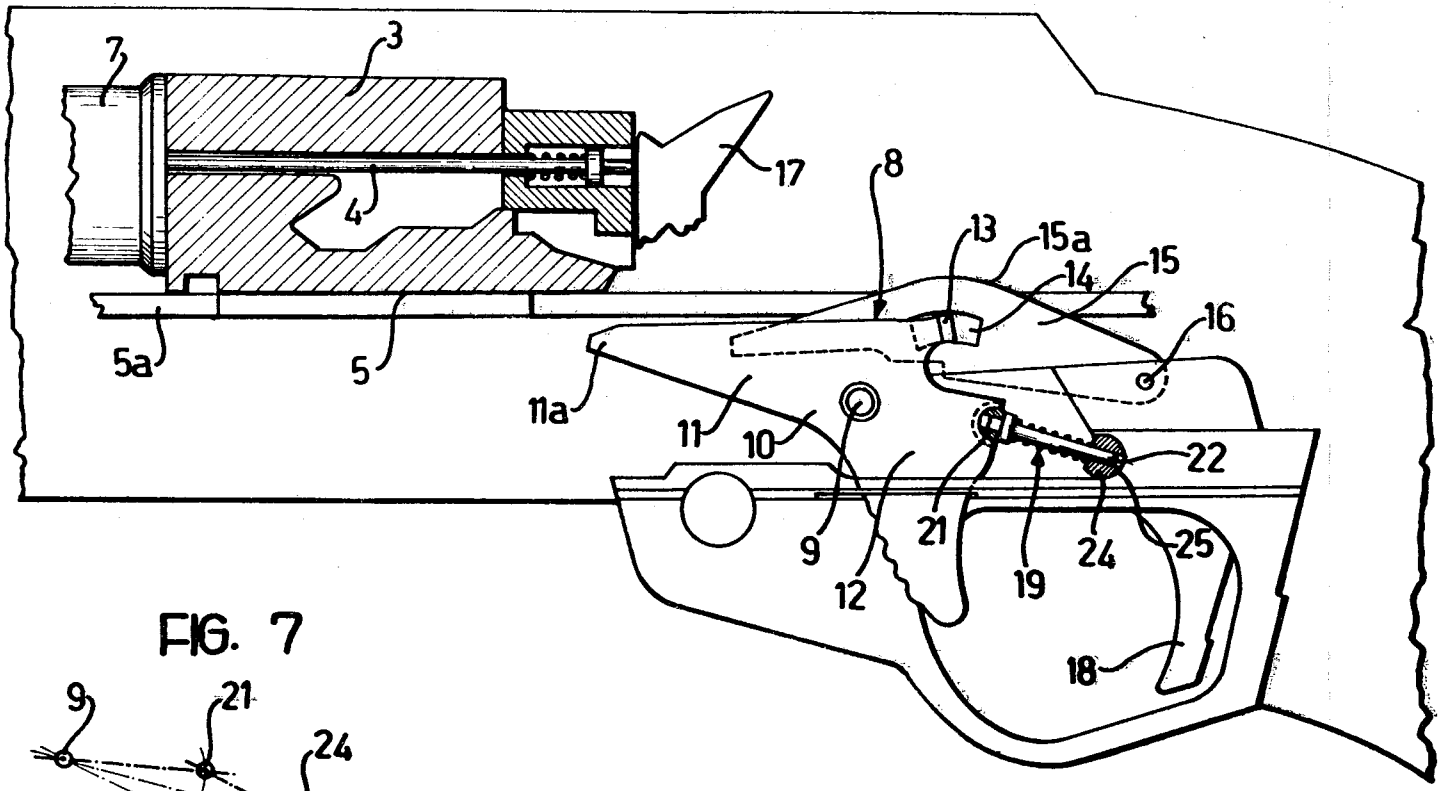
Figure 7:
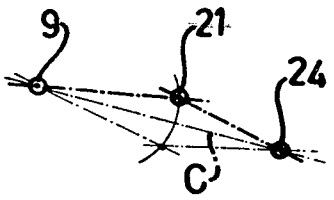

The angular displacements of the plate-like lever 10 are correlated with the angular displacements of the hammer 17 to which the said lever is connected by conventional means not shown. When the hammer 17, liberated by the trigger 18, is displaced angularly towards the breechblock 3 to strike the firing pin 4, the plate-like lever 10 is displaced angularly downwardly into its inoperative position specified above. By 19 is shown a thrust spring assembly including a shaft 20 which is pivotally attached at its opposite ends 21, 22 respectively to the portion 12 of the plate-like lever 10 and to the trigger mechanism housing 1, with pivot axes parallel to the axis of the pin 9 of the said plate-like lever 10. More particularly, the end 22 of the said shaft 20 is movable axially in a hole 23 formed in a spherical body 24 articulated in the form of a ball joint in a corresponding seat 25 formed in the housing 1. The thrust spring assembly 19 further includes a spring 26 fitted coaxially on to the shaft 20 and bearing at one end against a collar 21*a* of the shaft itself and at the other end against the spherical body 24 mentioned above. The points of pivoting of the thrust spring assembly 19 on the lever 10 and on the mechanism housing 1 respectively, are chosen so that when these are aligned with a point on the axis of the pin 9, in a straight joining line C, the spring 26 is in its condition of greatest compression. More particularly the said pivot points and the resilient strength of the spring 26 are chosen so that the thrust spring assembly 19 has two stable positions, disposed symmetrically with respect to the straight joining line indicated by C in the appended Figures, in which positions the straight line of action of the said spring 26 lies below and above the said joining line respectively. The presence of the thrust spring assembly 19 and its action on the plate-like lever 10 are such that the latter lever has two corresponding stable positions, angularly displaced with respect to the straight line C. More particularly, when the free end 11*a* of the lever 10 is in the operative position (FIG. 2), the straight line of action of the spring 26 lies in the position underneath the straight line C, while when the free end 11*a* of the lever 10 is in the inoperative position (FIG. 4) the straight line of action of the spring 26 lies completely above the straight line C.

The operation of the safety device of this invention is as follows.

In an initial condition (FIG. 2), the lever 10 has its free end 11*a* in the operative position that is to say bearing against the carrier 5 which is maintained in the position corresponding to closure of the firing chamber 7. The straight line of action of the spring 26 of the thrust spring assembly 19 lies completely below the straight line C considered above. When, after actuation of the trigger 18, the hammer 17 is displaced angularly to strike the firing pin 4, the lever 10 is displaced angularly about the pin 9 (in an anti-clockwise sense with reference to the appended drawings), so that the free end 11*a* is displaced into the inoperative position. The angular displacement of the lever 10 is resisted initially by the thrust spring assembly 19, a resistance which continues and increases until the spring 26 of the assembly has reached its point of maximum compression, that is to say until the straight line of action of the spring 26 coincides with the straight line C specified above. Immediately this point has been passed, the thrust spring assembly 19 facilitates the angular displacement of the lever 10 and, hence, the reaching of the inoperative position by the free end 11*a* of the lever itself.

The reaching of the inoperative position by the free end 11*a* of the stop member defining lever 10 simultaneously with the striking of the hammer 17 on the firing pin 4. The immediate, subsequent rebound of the hammer 17 does not result in the entrainment of the lever 10 since this is retained in its inoperative position by the thrust spring assembly 19.

Consequently, even when the gun is re-armed by the gas-take-off method, the immediate and violent displacement of the carrier 5 and of the breechblock 3 in opening the firing chamber may occur without any danger since the free end 11*a* of the stop member defining lever 10 is maintained in its position in which it does not lie in the path of the said carrier. The carrier 5 itself then causes the lever 10 to be brought to its operative position. Indeed, during the opening displacement, the carrier 5 encounters the upper edge 15*a* of the plate-like arm 15, causing it to rotate about the pin 16 in the lowering sense. The displacement of the arm 15, because of the engagement between the slot 14 thereof and the lug 13 of the lever 10, causes the latter to be displaced angularly (in the clockwise sense with reference to the Figures of the appended drawings) about its respective pin 9. This angular displacement is again resisted initially by the thrust spring assembly 19, then to be facilitated with reaching of the stable operative position immediately the carrier 5 and the shutter member 3 reach the position in which the firing chamber 7 is closed.

The invention conceived in this manner is susceptible of numerous variations and modifications. Thus, for example, the position of the thrust spring assembly 19 and the type of action which it exerts on the lever 10 may be changed (from the present action to a drawing action); variations of a geometric nature may also be made without thereby departing from the scope of protection of this invention as defined in the following claims.

What is claimed is:

1. In a gas-pump-type shot gun having a firing chamber; a breechblock carrier supporting a breechblock for translational movement between a first position in which said firing chamber is closed and a second position in which said firing chamber is open; a trigger mechanism; and a stop member defining lever mounted on a pivot pin carried by a housing of said trigger-mechanism for pivotal movement about an axis perpendicular to the direction of movement of the breechblock carrier between an operative position, in which a free end thereof bears against said breechblock carrier when said breechblock is in said first position, and an inoperative position in which said free end lies out of the path of movement of said carrier, a safety device for said trigger mechanism comprising a spring assembly pivotally connected at one end of said lever and at the opposite end to a fixed point on said shot gun, such that pivoting a said lever between said operative position and said inoperative position causes pivoting of said spring assembly between a first position and a second position respectively, said spring assembly defining a straight line of action which in said second position lies on one side of a straight line joining said fixed point to a point on said axis of the lever so that the spring assembly biases the lever towards said inoperative position, and said straight line of action of the spring assembly coinciding with said straight line joining said fixed point to said point on said axis in the maximum loading condition of said spring assembly.

2. A gas-pump type shot gun as claimed in claim 1, wherein said spring assembly comprises a thrust spring assembly.

3. A gas-pump type shot gun as claimed in claim 2, wherein said spring assembly comprises a shaft having a shoulder adjacent said one end of said spring assembly, and a compression spring coaxially surrounding said shaft, and said pivotal connection at said other end of said spring assembly comprises a ball-and-socket joint including a ball member defining a radial bore, the other end of said shaft being axially slidable in said bore, and wherein said compression spring bears at one end against said ball member and at the other end against said shoulder.

* * * * *